United States Patent [19]

Loy et al.

[11] Patent Number: 4,814,663

[45] Date of Patent: Mar. 21, 1989

[54] FLUORESCENT LAMP FOR UNIPOLAR MODE OF OPERATION

[75] Inventors: Helmut M. Loy, Nuremberg; Armin Eich, Erlangen; Sigurd Kohler, Hochstadt, all of Fed. Rep. of Germany

[73] Assignee: GTE Products Corporation, Danvers, Mass.

[21] Appl. No.: 53,295

[22] PCT Filed: Jul. 21, 1986

[86] PCT No.: PCT/EP86/00429

§ 371 Date: Apr. 16, 1987

§ 102(e) Date: Apr. 16, 1987

[87] PCT Pub. No.: WO87/00683

PCT Pub. Date: Jan. 29, 1987

[30] Foreign Application Priority Data

Jul. 19, 1985 [DE] Fed. Rep. of Germany ..... 3525888

[51] Int. Cl.[4] ..... H01J 61/06

[52] U.S. Cl. ..... 313/39; 313/632

[58] Field of Search ..... 313/39, 46, 591, 631, 313/632

[56] References Cited

U.S. PATENT DOCUMENTS 4,173,730 11/1979 Young et al. ..... 315/53

FOREIGN PATENT DOCUMENTS 923497 2/1955 Fed. Rep. of Germany .

1322083 2/1963 France .

OTHER PUBLICATIONS

Meyer et al., GTE Technical Newsletter, vol. 6, No. 6, pp. 1 & 2 Dec., 1984.

*Primary Examiner*—David K. Moore

*Assistant Examiner*—Sandra L. O'Shea

*Attorney, Agent, or Firm*—Carlo S. Bessone; Edward J. Coleman

[57] ABSTRACT

For far-reaching reduction of cataphoresis of a fluorescent lamp for unipolar mode of operation, the anode thereof is such that in order to decrease anode current density its surface effective for the formation of the electric field of discharge amounts to 60–100 % of the maximal cross-sectional area of the discharge envelope, measured vertically to the discharge axis. Suitably the anode is provided with heat dissipators to thereby obtain a still greater temperature gradient. A permanent external heating of the cathode permits a particularly good igniting behaviour and a simple luminosity regulation which are advantageous when the lamp is used for reproduction of alphanumeric characters and images e.g. in a matrix, a display or the like.

4 Claims, 1 Drawing Sheet

FLUORESCENT LAMP FOR UNIPOLAR MODE OF OPERATION

BACKGROUND OF THE INVENTION

This invention relates to a fluorescent lamp for unipolar mode of operation such as is described in "Lichttechnik", 30th Year, No. 3, 1978, pages 106 to 108.

Such a fluorescent lamp is filled predominantly with mercury vapour, while the inner face of the glass envelope thereof is coated with a fluorescent material. Unipolar mode of operation is a power supply with direct current or with a clocked d.c. voltage, namely with a voltage pulsating with only one polarity, such as a sinusoidal half-wave voltage, a rectangular pulse train etc. A direct current operation, especially of low pressure gas discharge lamps, is such that for physically plausible and experimentally proved reasons—so far as ohmic stabilizing resistances can be avoided—the same leads to a light yield which, as compared to the conventional alternating current operation, is improved by 20% and more.

Yet in the direct current operation mercury ions migrate from the anode to the cathode, which is why the anode region undergoes a mercury impoverishment, whereby the light yield in the anode region is decreased. This phenomenon is also called cataphoresis.

Now in order to reduce cataphoresis, in the case of the fluorescent lamp mentioned in the first paragraphs hereinabove and constructed as a double tube lamp it has been proposed to use a special diaphragm which is permeable to mercury vapor yet which is gas-discharge-tight. However, the use of a suchlike diaphragm and the construction of a double tube lamp represent a considerable expenditure.

From "Technical Newsletter", December 1984, Vol. 6, No. 6, pages 1 and 2 is known a fluorescent lamp the cathode of which is permanently heated in order to provide ideal conditions for igniting the arc discharge and for maintaining the same, as well as a sufficiently high Hg vapour pressure which, in the case of a high switching frequency, is advantageous.

SUMMARY OF THE INVENTION

The problem underlying the invention is to provide a fluorescent lamp for unipolar mode of operation wherein the cataphoresis effect can be decreased to a far-reaching extent by simple means.

The invention is based on the discovery that the cataphoresis can be decreased to a far-reaching extent in that between the cathode and the anode of the fluorescent lamp there is produced a greater temperature gradient. That is why in accordance with the invention the anode is dimensioned so as to have as large an area as possible so that at nominal output the anode should have a small current density and more particularly only up to $10^{-5}$ A/cm$^2$ whereby achieving that in spite of a sufficient electron beam—stream of electrons—the anode is heated only a little. The anode has a surface which amounts to 60–100% of the maximal cross-sectional area of the discharge envelope, measured vertically to the discharge axis. The arrangement of heat dissipators aids in achieving the desired low temperature of the anode, which moreover prevents the electrode material at the anode side from blackening. The large area anode leads to less anode drop, less anode dissipation and to a higher efficiency.

The small anode current density does also lead to a decrease of the amplitude of the relaxation oscillations in the anode region whereby lesser high frequency distortions occur.

The use of a permanently heated cathode does not only serve for avoiding cataphoresis but it also enhances the controllability of the fluorescent lamp and decreases the cathode drop. Quite generally an external heating of the cathode is compulsorily required for luminosity regulation of the lamp by a variation of the anode current and/or by pulse modulation. Namely in the case of a small effective lamp current this current is not sufficient to heat the cathode to full emission temperature. External cathode heating to a constant emission temperature can take place by direct or alternating current. In a case in which several lamps are operated, the heaters can be connected in parallel and supplied by merely one constant voltage source. Hence it follows that an external and moreover also permanent heating of the cathode is above all advantageous for fluorescent lamps finding use for the reproduction of alphanumeric characters and images within the scope of an indicating matrix, a display device and the like.

BRIEF DESCRIPTION OF THE DRAWINGS

The invention will be described hereinafter by way of example in the light of an exemplary embodiment shown in the attached drawing wherein.

BEST MODE FOR CARRYING OUT THE INVENTION

Figure 1:
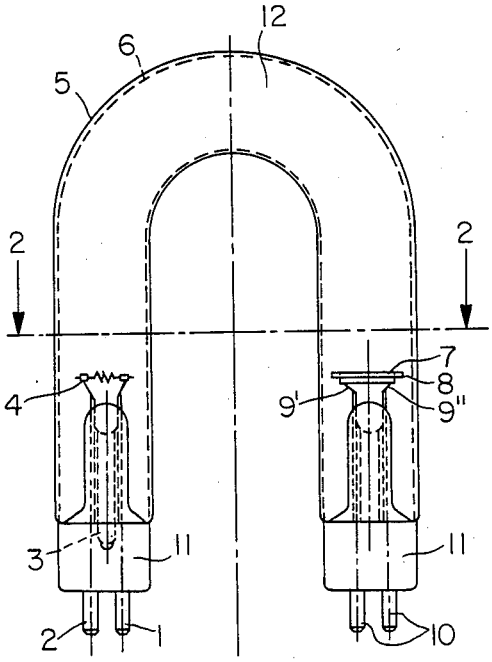
FIG. 1 shows a top plan view of a fluorescent lamp.
Figure 2:
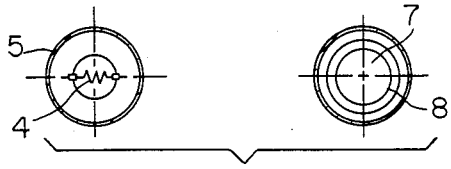
FIG. 2 shows a sectional view through the fluorescent lamp along the line 2—2 in FIG. 1.

The fluorescent lamp includes an U-shaped bent discharge envelope 5 of glass the inner wall of which is coated with a fluorescent material. The tube ends fit in two uniform bases 11. One of the bases does by way of the pump stem 3 carry the cathode 4 in the form of an oxide-coated tungsten coil which is perrmanently heated from the outside by energy supply via cathode heating terminals 1 and 2 and thereby emits electrons. The other base carries the anode 7 in the form of a disc or round member the effective surface of which is tantamount to 73% of the cross-sectional area of the discharge envelope 5. The anode is advantageously provided with a mercury dispenser in the form of a circular bead 8 which is filled with mercury. At the anode 7 are disposed two heat dissipators 9' and 9'' of a material having a high thermal conductivity which simultaneously serve as anode holder. The two heat dissipators 9' and 9'' are connected to two outwardly leading lamp connection pins 10 to carry off the heat from the lamp to the outside. The anode embodied as a metal body having a relatively large surface can also have the shape of a hollow cylinder, a semisphere or a truncated cone.

The anode current density at nominal output is preferably tantamount to $10^{-5}$ to about $10^{-7}$ A/cm$^2$. More than $10^{-5}$ A/cm$^2$ are not purposeful.

In one exemplary embodiment wherein a so-called Penning mixture was used, e.g. Ar-Hg (stimulated Ar atoms of the metastable level of 11,5 eV ionize Hg atoms of the ionization energy 10,4 eV), the following values have been obtained:

| | |
|---|---|
| gas pressure Ar: | ca. 1 to 10 mbar |

-continued

| | |
|---|---|
| gas pressure Hg: | ca. $10^{-3}$ to $10^{-2}$ mbar |
| quantity Hg: | 10 mg (0.7 mg/cm$^3$) |
| burning voltage: | ca. 25 to 30 V |
| lamp current: | 1 to 200 mA |
| lamp output: | 3–5 W max |
| heating output: | ca. 0.5 to 1 W |
| igniting pulse: | ca. 300 to 400 V, 2 to 20 μsec |
| anode current density: | ca. 1 mA/mm$^2$ |
| light current: (colour green) | ca. 250 lm |

It is to be emphasized that naturally the shape of the discharge envelope can differ from the exemplary embodiment shape described above. In particular for the production of so-called pixels it is possible to use elongated, also rectangular or respectively square discharge envelopes having discharge paths for the three colours red, green and blue.

What is claimed is:

1. A fluorescent lamp for unipolar mode of operation having a discharge envelope, a cathode and an anode, characterized in that the anode has a surface which amounts to 60–100% of the maximal cross-sectional area of the discharge envelope measured vertically to the discharge axis, effective for the formation of the electric field to provide a greater temperature gradient that reduces lamp cataphoresis.

2. The fluorescent lamp according to claim 1, characterized in that the anode (8) is connected to at least two heat dissipators (9', 9'') of a material having a high thermal conductivity for carrying off of the heat from the lamp outwardly.

3. The fluorescent lamp according to claim 2 having two heat dissipators, characterized in that the heat dissipators (9', 9'') merge into two lamp connection pins (10).

4. A fluorescent lamp according to claim 1, 2 or 3, in particular for the reproduction of alphanumeric characters (letters and numbers) and images within the scope of a display matrix, characterized in that the cathode is externally and permanently heated.

* * * * *